US005459016A

United States Patent [19]

Debe et al.

[11] Patent Number: 5,459,016

[45] Date of Patent: Oct. 17, 1995

[54] NANOSTRUCTURED THERMAL TRANSFER DONOR ELEMENT

[75] Inventors: Mark K. Debe, Stillwater; William V. Dower, St. Paul, both of Minn.

[73] Assignee: Minnesota Mining and Manufacturing Company, Saint Paul, Minn.

[21] Appl. No.: 168,768

[22] Filed: Dec. 16, 1993

[51] Int. Cl.[6] ..... B41M 5/26

[52] U.S. Cl. ..... 430/201; 430/200; 430/271; 430/275; 430/964; 428/156; 428/164; 428/195; 428/202; 428/209; 428/336; 428/337; 428/341; 428/913; 428/914

[58] Field of Search ..... 430/200, 201, 430/271, 275, 964; 428/156, 164, 195, 202, 209, 336, 337, 341, 913, 914

[56] References Cited

U.S. PATENT DOCUMENTS

| | | | |
|---|---|---|---|
| 3,645,917 | 2/1972 | Vandenberg . | |
| 3,694,383 | 9/1972 | Azami et al. . | |
| 4,148,294 | 4/1979 | Scherber et al. . | |
| 4,155,781 | 5/1979 | Diepers . | |
| 4,209,008 | 6/1980 | Lemkey et al. . | |
| 4,252,864 | 2/1981 | Coldren | 428/571 |
| 4,396,643 | 8/1983 | Kuehn | 427/160 |
| 4,588,674 | 5/1986 | Stewart et al. | 430/273 |
| 4,812,352 | 3/1989 | Debe | 428/142 |
| 4,879,419 | 11/1989 | Johannessen | 568/606 |
| 4,969,545 | 11/1990 | Hayashi | 192/0.076 |
| 5,039,561 | 8/1991 | Debe | 427/255.6 |
| 5,089,372 | 2/1992 | Kirihata et al. | 430/167 |
| 5,156,938 | 10/1992 | Foley et al. | 430/200 |
| 5,238,729 | 8/1993 | Debe | 428/245 |
| 5,278,023 | 1/1994 | Bills et al. | 430/201 |
| 5,326,619 | 7/1994 | Dower et al. | 428/164 |

FOREIGN PATENT DOCUMENTS

WO92/06410 4/1992 WIPO .

*Primary Examiner*—Charles L. Bowers, Jr.
*Assistant Examiner*—Christopher G. Young
*Attorney, Agent, or Firm*—Gary L. Griswold; Walter N. Kirn

[57] ABSTRACT

Laser-addressable thermal transfer donor elements for producing color proofs, printing plates, films, printed circuit boards, and other media are disclosed. The thermal transfer donor elements include a substrate with a gas-producing polymer layer thereon, and an array of discrete nanostructured elements embedded within the gas-producing polymer layer. The gas-producing polymer layer has a thermally available nitrogen content of greater than about 10 weight percent. Each of the nanostructured elements includes an elongated structure conformally coated with a radiation absorbing material. A thermal mass transfer material (e.g., a metal or colorant such as a dye or pigment) is included in or over the gas-producing polymer layer.

38 Claims, 1 Drawing Sheet

NANOSTRUCTURED THERMAL TRANSFER DONOR ELEMENT

FIELD OF THE INVENTION

The present invention relates to thermally imageable materials for the production of printed circuit boards as well as color proofs, printing plates, films, and other graphic arts media using thermal transfer imaging methods. More particularly, the invention relates to thermal transfer donor elements having a gas-producing polymer with radiation absorbing nanostructured elements therein.

BACKGROUND OF THE INVENTION

The phenomenon of laser-induced ablation transfer imaging is generically known and is believed to entail both complex non-equilibrium physical and chemical mechanisms. Such laser-induced ablation transfer is thought to be effected by the rapid and transient accumulation of pressure beneath and/or within a mass transfer layer initiated by imagewise irradiation. Transient pressure accumulation can be attributed to one or more of the following factors: rapid gas formation via chemical decomposition and/or rapid heating of trapped gases, evaporation, photo expansion, thermal expansion, ionization and/or by propagation of a pressure-wave. The force produced by the release of such pressure is sufficient to cause transfer of the imaging layer to an adjacent receptor element. The force is preferably sufficient to effect the complete transfer of the exposed area of a layer rather than the partial or selective transfer of components thereof.

Laser-induced thermal mass transfer of materials from a donor sheet to a receptor layer has been described in the patent and technical literature for nearly thirty years. However, few commercial systems have utilized this technology. Exposure fluences required to transfer materials to a receptor have been, at best, on the order of 0.1 Joule/cm$^2$ (i.e., J/cm$^2$). Consequently, lasers capable of emitting more than 5 Watts of power, typically water-cooled Nd:YAG lasers, have been required to produce large format images (A3 or larger) in reasonable times. These lasers are expensive and impractical for many applications. More recently, single-mode laser diodes and diode-pumped lasers producing 0.1–4 Watts in the near infrared region of the electromagnetic spectrum have become commercially available. Diode-pumped Nd:YAG lasers are good examples of this type of source. They are compact, efficient, and relatively inexpensive. In order to use these new sources in a single-beam, large format imaging system, the exposure fluence of thermal transfer materials should be reduced to less than 0.04 J/cm$^2$ and the exposure pixel dwell time should be less than 300 nanoseconds. There have been many unsuccessful efforts in the art to achieve this goal.

Recently, however, U.S. Patent application Ser. No. 07/977,215, filed Nov. 16, 1992 and entitled "PROPELLANT-CONTAINING THERMAL TRANSFER DONOR ELEMENTS," disclosed a thermal transfer donor element containing a gas-producing polymer having a thermally available nitrogen content of greater than about 10 weight percent, a radiation absorber, and a thermal mass transfer material. Such gas-producing polymers generate a high propulsive force, thereby decreasing the exposure fluence required to induce transfer of imaging material to a receptor layer material. For this reason, the gas-producing polymers enable the use of simple, single-beam scanners based on diode-pumped lasers such as diode-pumped Nd:YAG lasers.

Generally, three types of radiation absorbers are used in thermal mass transfer imaging systems: dyes, particles, and thin layers of metal. The use of dyes as a radiation absorber is disclosed in U.S. Pat. No. 5,156,938. In this role, however, dyes are undesirable because of their high cost, reactivity/incompatibility with other components of the thermal transfer system (which, in turn, leads to instability and a low shelf life), and susceptibility to decomposition under the high temperature conditions which exist during thermal imaging.

Particle-type radiation absorbers are disclosed in, e.g., U.S. Pat. No. 4,588,674, UK Patent Application GB 2 083 726, and Japanese Kokai Patent Application No. SHO 63-161445. Such particles are generally dispersed in a binder. The most common particle-type radiation absorber is carbon black. Because the particles are discrete and randomly distributed in the binder, they must be present in relatively thick (i.e., greater than 0.5 micrometers) layers in order to generate sufficient heat for mass transfer. Since the amount of radiant energy required to heat a layer is directly proportional to the thickness of that layer, however, such thick layers are undesirable from both a speed and energy usage standpoint. In addition, when carbon black is used as a particle absorber (which is typically the case), the persistent color of the particles generally restricts their use to thermal mass transfer systems which are black and white.

Thin-layered metal absorbers avoid the disadvantages of dye and particle absorbers by combining low cost, high compatibility and high stability with the ability to provide sufficient heat for mass transfer when coated in thin (i.e., around 0.1 to 0.01 micrometers) layers. In this manner, thin-layered metal radiation absorbers increase the efficiency of the imaging process by allowing greater speed and lower energy usage. For example, copending U.S. patent application Ser. No. 08/033,112, filed Mar. 18, 1993 and entitled "LASER PROPULSION TRANSFER USING BLACK METAL COATED SUBSTRATES," discloses a thermal transfer donor element containing, in order, a substrate, a black metal radiation absorbing layer on one surface of the substrate, a gas generating polymer layer over the black metal layer, and a colorant over the black metal layer. The donor element is particularly useful for ablative thermal mass transfer imaging.

SUMMARY OF THE INVENTION

In accordance with the present invention, it has now been discovered that the efficiency of ablative thermal mass transfer imaging can be improved by providing an array of radiation-absorbing nanostructured elements in a gas-producing polymer layer.

Thus, the present invention provides a thermal transfer donor element, comprising:

a) a substrate having an upper major surface and a lower major surface;

b) a gas-producing polymer layer on the upper major surface of the substrate, said gas-producing polymer layer having a thermally available nitrogen content of greater than 10 weight percent;

c) a plurality of discrete nanostructured elements within the gas-producing polymer layer (e.g., embedded in the gas-producing polymer layer), each of the nanostructured elements comprising an elongated (whisker-like) structure conformally coated with a radiation absorbing material; and d) a thermal mass transfer material in or over the gas-producing polymer layer.

As used herein:

"acicular" means having an aspect ratio of ≧3;

"aspect ratio" means a ratio of an element's length (longest or major dimension) to its average cross-sectional width (shortest or minor dimension);

"discrete" means distinct elements, having a separate identity, but does not preclude elements from being in contact with one another;

"elongated structure" means the inert core of the nanostructured element, and may be shaped, for example, as a whisker, fibril, rod, cone, cylinder, lath, pyramid, or other regular or irregular geometric shaped structure;

"nanostructured element" means an acicular, discrete, oriented, sub-microscopic, two-component structure comprised of an elongated structure coated with a radiation absorbing material;

"oriented" includes random or uniaxial;

"radiation absorbing material" includes any material capable of absorbing at least 1% of incident electromagnetic radiation;

"submicroscopic" means having at least one dimension smaller than approximately a micrometer;

"thermally available nitrogen content" refers to the nitrogen content (weight percentage basis) of a material which, upon exposure to heat (preferably less than about 300° C. and more preferably less than about 250° C.), generates or liberates nitrogen ($N_2$) gas;

"thermal mass transfer material" refers to a material such as, for example, a colorant, metal, pigment, or a crystalline dye (with or without binder) which is transferred in a substantially non-molecular state, i.e., as pieces, chunks, aggregates, or groups of associated molecules, including those dissolved in a binder, in thermal imaging processes from a donor element to the surface of a receptor element by action of a thermal source; and "uniaxial" means that the major axes of the nanostructured elements are uniformly oriented in approximately the same direction.

The thermal transfer donor element is particularly advantageous for laser-addressed, ablative thermal mass transfer imaging. The nanostructured elements improve the efficiency of the present donor element beyond conventional donor elements which employ thin-layered, planar metal absorbers by decreasing the loss of radiant imaging energy due to reflection (i.e., by increasing the absorption of such energy) and by increasing the contact surface area between the radiation absorbing material and the gas-producing polymer. Multiple scatterings (i.e., reflections/absorptions of radiant imaging energy) between the nanostructured elements enhance the absorption and conversion of radiant energy to heat. The increased surface area, in turn, facilitates the diffusion of that heat away from the nanostructured elements and into the surrounding gas-producing polymer.

Surprisingly, the nanostructured elements have also been found to improve the quality of the final image produced by the present donor element beyond those images which are produced by conventional donor elements having thin-layered, planar metal absorbers. During ablative mass transfer imaging, pieces of metal which are large enough to affect the quality of the resulting image are observed to separate from conventional (i.e., planar, non-nanostructured) metal absorbing layers and carry over onto the image produced on a receptor sheet along with the ablated mass transfer material. Such pieces of metal are visibly noticeable in the final image. This deleterious effect is substantially avoided by the nanostructured construction of the present invention. Such a construction reduces both the size and variation in size of metal particles which are carried over to the receptor sheet during ablative imaging, thereby resulting in a higher quality final image.

Other aspects, benefits, and advantages of the present invention are apparent from the detailed description, examples, and claims.

DETAILED DESCRIPTION OF THE INVENTION

Figure 1:
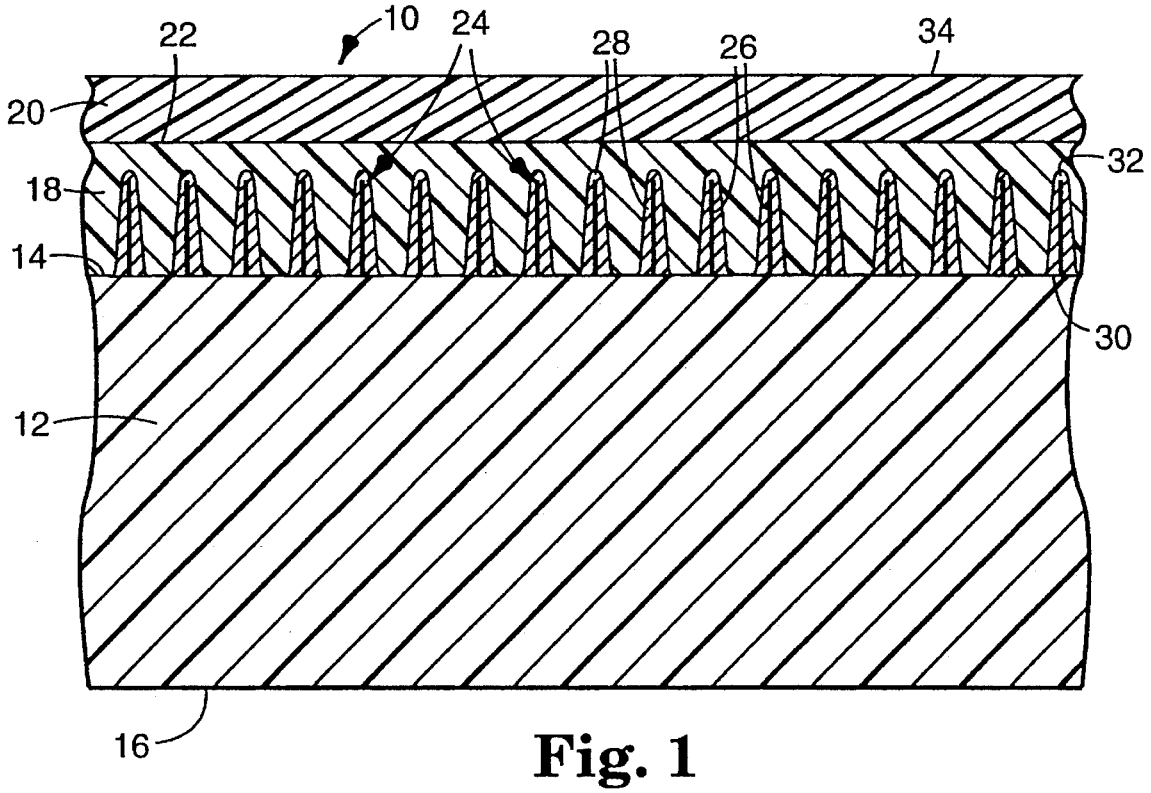
FIG. 1 is an enlarged sectional view of one embodiment of the present thermal transfer donor element, and illustrates a substrate with a gas-producing polymer layer thereon, an array of nanostructured elements embedded within the gas-producing polymer and contacting the substrate, and a thermal mass transfer material layered on the gas-producing polymer layer.

Referring to FIG. 1, there is shown a first embodiment of the thermal transfer donor element of the present invention. Thermal transfer donor element 10 includes a substrate 12 having an upper major surface 14 and a lower major surface 16. Gas-producing polymer layer 18 is on upper surface 14 of substrate 12, while thermal mass transfer material 20 is present as a layer on upper major surface 22 of gas-producing polymer layer 18. Alternatively, mass transfer material 20 may be mixed with gas-producing polymer layer 18 as a single layer on upper surface 14 of substrate 12.

Embedded within gas-producing polymer layer 18 is a plurality (e.g., a regular or random array) of discrete nanostructured elements 24. Each of nanostructured elements 24 comprises an elongated, whisker-like structure 26 coated (e.g., conformally) with radiation absorbing material 28. Nanostructured elements 24 each have a first end 30 in contact with the upper surface 14 of substrate 12, and a second end 32 contained within gas-producing polymer layer 18.

Figure 2:
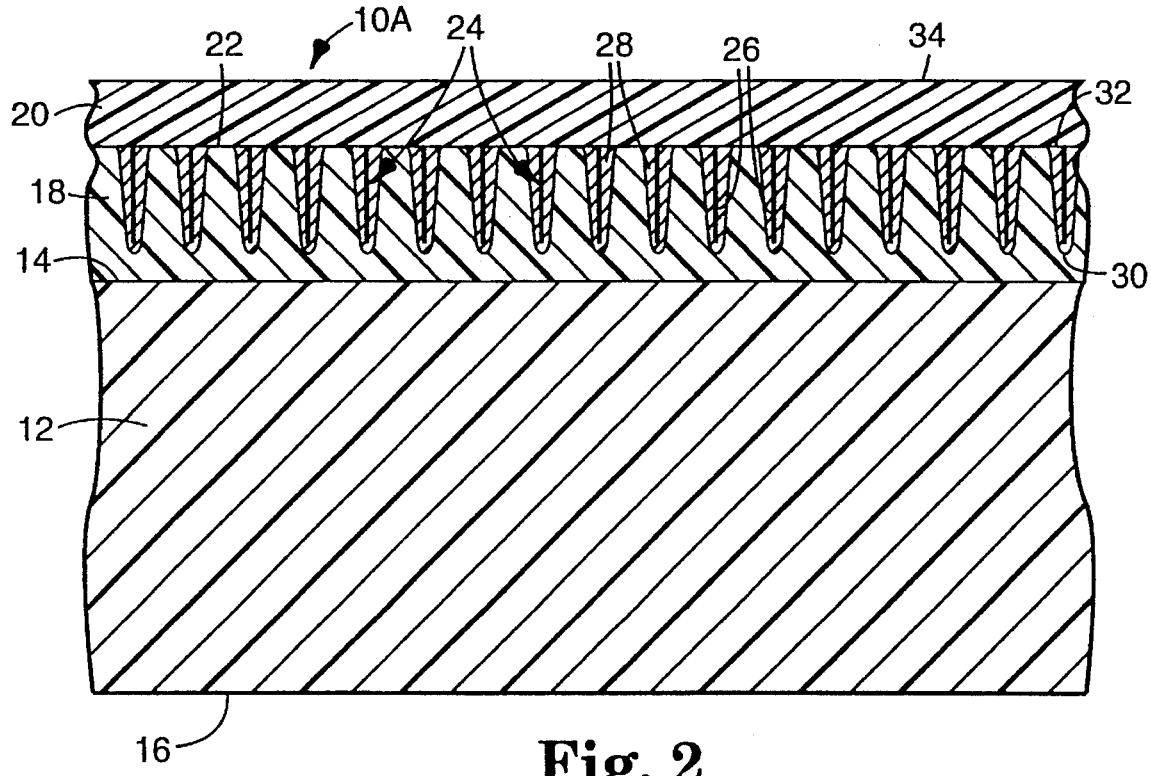
FIG. 2 is an enlarged sectional view of another embodiment of the present thermal transfer donor element, and illustrates a substrate with a gas-producing polymer layer thereon, a thermal mass transfer material layered on the gas-producing polymer layer, and an array of nanostructured elements embedded within the gas-producing polymer and contacting the thermal mass transfer material.

FIG. 2 illustrates a second embodiment of the thermal transfer donor element of the present invention. Thermal transfer donor element 10A is similar in all respects to thermal transfer donor element 10 in FIG. 1 except that first end 30 of nanostructured elements 24 are contained within gas-producing polymer layer 18 while second end 32 is coincident with upper surface 22 of gas-producing polymer layer 18.

Suitable materials from which substrate 12 may be constructed include, without limitation, plastic sheets and films such as those made of polyethylene terephthalate, polyimide, fluorene polyester polymer consisting essentially of repeating interpolymerized units derived from 9,9-bis(4-hydroxyphenyl)fluorene and isophthalic acid (referred to hereinbelow as a fluorenone polyester), terephthalic acid or mixtures thereof, polyethylene, polypropylene, polyvinyl chloride and copolymers thereof, and hydrolyzed and unhydrolyzed cellulose acetate. Preferably, substrate 12 is transparent so that a laser may be imaged through the lower surface 16. This allows the use of a non-transparent receptor sheet (which is placed in contact with the top surface 34 of donor element 10 or 10A during the imaging process).

Gas-producing polymer layer 18 has a thermally available nitrogen content greater than about 10 weight percent, preferably greater than about 20 weight percent, and more preferably greater than about 30 weight percent. Preferably, the gas-producing polymer is thermally decomposable at a temperature below about 300° C., and most preferably, below about 250° C.

The gas-producing polymer may be any polymer that liberates gas, especially nitrogen gas ($N_2$) when heated rapidly, such as, for example, by exposure of the construction to an infrared laser beam. Polymers that liberate nitrogen gas on heating generally have thermally decomposable functional groups. The polymer may itself be gas-liberating or may contain a dispersion or addition of materials that can decompose to produce gases when irradiated, such as diazonium salts and polymers. Non-limiting examples of suitable thermally decomposable functional groups include azido, alkylazo, diazo, diazonium, diazirino, nitro, difluoroamino, $CF(NO_2)_2$, cyano, nitrato, triazole, etc. The thermally decomposable groups may be incorporated into the gas-producing polymer either prior to polymerization or by modification of an existing polymer, such as, for example, by diazotization of an aromatic ring (e.g., with sodium nitrite) or diazo transfer with tosyl azide onto an amine or β-diketone in the presence of triethylamine.

In one preferred embodiment, the gas-producing polymer has the formula $$(X\text{-}R)_{n}\text{-}L_{m} \qquad \text{(I)}$$

wherein:

X represents a hydroxyl, azide, mercapto, or amino (including mono-alkyl and mono-aryl substituted amino) group and preferably, X is an azide or a hydroxyl group;

R represents a divalent monomer group, containing a $N_3$ group, derived from a cyclic ether such as, for example, $—CH_2CH(CH_2N_3)O—$, $—CH_2C(CH_3)(CH_2N_3)CH_2O—$, $—CH(CH_2N_3)CH_2O—$, $—CH_2C(CH_2N_3)_2CH_2O—$, $—CH(CH_2N_3)CH(CH_2N_3)O—$, and $—CH_2CH(N_3)CH_2O—$; a cyclic sulfide such as, for example, $—CH_2CH(CH_2N_3)S—$, $—CH_2C(CH_2N_3)_2CH_2S—$, $—CH(CH_2N_3)CH(CH_2N_3)S—$, and $—CH_2CH(N_3)CH_2S—$; and a cyclic amine such as for example, $—CH_2CH(CH_2N_3)NR^1—$, $—CH(CH_2N_3)CH_2NR^1—$, $—CH_2C(CH_2N_3)_2CH_2NR^1—$, $—CH(CH_2N_3)CH(CH_2N_3)NR^1—$, and $—CH_2CH(N_3)CH_2NR^1—$;

$R^1$ represents a hydrocarbyl group (e.g., alkyl, aryl, aralkyl, alkaryl, etc.);

L represents a mono-, di-, tri- or tetra-valent alkyl radical. Non-limiting examples of monovalent radicals are methyl and ethyl. Non-limiting examples of polyvalent alkyl radicals are ethylene, methylene, propylene, 1,2,3-propanetriyl, 2,2-dimethylene- 1,3-propanediyl, etc. Preferably, L is 1,2, 3-propanetriyl;

corresponding to L, m represents 1, 2, 3, or 4; and n represents any positive integer greater than 1, preferably greater than 5, and more preferably greater than 10.

The foregoing gas-producing polymer of Formula (I) can be made by procedures well known to those skilled in the art of synthetic organic chemistry such as disclosed, for example, in U.S. Pat. Nos. 3,645,917 and 4,879,419, the disclosures of which are incorporated herein by reference.

One or more crosslinking agents may be employed in combination with the gas-producing polymer of Formula I to provide coatings having improved strength. The choice of an appropriate crosslinking agent depends on the functional groups pendant on the gas-producing polymer. Thus, if hydroxyl groups are present on the gas-producing polymer, then crosslinking agents for polyols could be employed (e.g., isocyanates). In cases where free-radically polymerizable pendant groups, such as acrylates, are attached to the polymer backbone, a free-radical initiator may be used as a crosslinking agent.

Preferably, a crosslinking agent for polyols is employed in combination with a gas-producing polymer having multiple hydroxyl end groups. Preferred crosslinking agents in this case are polyisocyanates, including but not limited to, hexamethylene diisocyanate; diphenylmethane diisocyanate; bis(4-isocyanatocyclohexyl)methane, 2,4-tolylene diisocyanate, etc.

In another preferred embodiment, the gas-producing polymer is a polyoxetane having recurring units of the following formula:

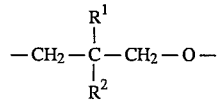

(II)

wherein $R^1$ and $R^2$ each independently represent a thermally decomposable nitrogen-containing group, e.g., azido, nitro, nitrato, triazole, etc. An example of a preferred azido group is $—CH_2N_3$. A preferred polyoxetane is poly[bis(azidomethyl)oxetane].

The gas-producing polymer of Formula (II) can be made by procedures well known to those skilled in the art of synthetic organic chemistry such as disclosed, for example, in U.S. Pat. No. 3,694,383, the disclosure of which is incorporated herein by reference.

In another preferred embodiment, the gas-producing polymer is an energetic copolymer. An energetic copolymer may be defined as a polymer which contains functional groups which exothermically decompose to generate gases, shock waves, pressure, etc. when heated above a certain threshold temperature on the millisecond to nanosecond timescale. Preferably, the energetic copolymer has repeating units derived from different monomers, one or both of which have pendant energetic nitrogen-containing groups such as azido, nitro, nitrato, or nitramino derivatives. Preferably, the monomers are cyclic oxides having three to six ring atoms. The energetic monomers are preferably azido, nitro, triazole, or nitrato derivatives of oxirane, oxetane or tetrahydrofuran. Examples (non-inclusive) of such energetic copolymers are Poly[bis(azidomethyl)oxetane] (BAMO), glycidyl azide polymers (GAP), polyvinyl nitrate (PVN), nitrocellulose, and polycarbonates. Copolymerization of the monomers is preferably carried out by cationic polymerization. The foregoing energetic copolymers and their method of preparation are disclosed in U.S. Pat. No. 4,483,978, the disclosure of which is incorporated herein by reference.

An energetic copolymer may also be defined as a polymeric material which contains energetic additives, gas forming additives, or catalysts for the thermal or photochemical decomposition thereof. Energetic additives may be used to modify the physical and thermal properties of the above-mentioned energetic polymers. Such additives lower the decomposition temperature, and may be used either as plasticizers or "kickers." Examples (non-inclusive) of such additives are the energetic molecules RDX (hexahydro-1,3, 5-trinitro- 1,3,5-triazine), TNT (trinitrotoluene), and PETN (pentaerythritol tetranitrate). Gas forming additives are molecules which thermally decompose to form a large quantity of gaseous products. Examples (non-inclusive) include diazonium salts (e.g., 4-methoxybenzene diazonium tetrafluoroborate), azides (e.g., 4-azidobenzoic acid), and "blowing agents" (e.g., 2,2'-azobis-2-methyl-butyronitrile and p-toluene sulfonylhydrazide). Catalysts are compounds which lower the temperature of decomposition of the energetic polymers or additives. Examples (non-inclusive) include acids, bases, and organometallic species such as ferric acetylacetonate.

Thermal mass transfer material 20 may include dyes such as those listed in Venkataraman, *The Chemistry of Synthetic Dyes*; Academic Press, 1970: Vols. 1–4, and *The Colour Index Society of Dyers and Colourists*, Yorkshire, England, Vols. 1–8, including cyanine dyes (including streptocyanine, merocyanine, and carbocyanine dyes), squarylium dyes, oxonol dyes, anthraquinone dyes, and homopolar dyes, polycyclic aromatic hydrocarbons, etc.; metal oxides and mixed oxides such as titanium dioxide, silica, alumina, oxides of chromium, iron, cobalt, manganese, nickel, copper, zinc, indium, tin, antimony and lead, black aluminum; metal films, metal sulfides, and metal nitrides derived from virtually any atmospherically stable metal including, but not limited to, aluminum, scandium, titanium, vanadium, chromium, manganese, iron, cobalt, nickel, copper, zinc, gallium, germanium, yttrium, zirconium, niobium, molybdenum, ruthenium, rhodium, palladium, silver, cadmium, indium, tin, antimony, lanthanum, gadolinium, hafnium, tantalum, tungsten, rhenium, osmium, iridium, platinum, gold, thallium, and lead; colored and/or fluorescent pigments known for use in the imaging arts including those listed in the *Pigment Handbook*; Lewis, P. A., Ed.: Wiley; New York, 1988, or available from commercial sources such as Hilton-Davis, Sun Chemical Co., Aldrich Chemical Co., Imperial Chemical Industries, etc.; semiconductors such as carbon (including diamond graphite), silicon, arsenic, gallium arsenide, gallium antimonide, gallium phosphide, aluminum antimonide, indium antimonide, indium tin oxide, zinc antimonide, etc.; electrographic or electrophotographic toners; phosphors, such as those used for television or medical imaging purposes; electroless plating catalysts; polymerization catalysts; curing agents; and photoinitiators.

It is often desirable to provide a modified surface (for example, to increase or decrease adhesion or wetability) to a receptor substrate in an image-wise fashion. For those applications, the transfer materials may be polymers or copolymers such as silicone polymers as described by M. W. Ranney in *Silicones*: Noyes Data Corp., 1977, Vols. 1 and 2; fluorinated polymers, polyurethanes, acrylic polymers, epoxy polymers, polyolefins, styrene-butadiene copolymers, styrene-acrylonitrile copolymers, polyethers, and phenolic resins such as novolak resins, and resole resins.

In other cases it is desirable to transfer curable materials such as monomers or uncured oligomers or crosslinkable resins. In those cases the thermal mass transfer material may be a polymerizable monomer or oligomer. The properties of the material should be selected so that volatility of the monomer or oligomer is minimal to avoid storage problems. Suitable polymerizable materials include acrylate-terminated polysiloxanes, polyurethanes, polyethers, etc.

To improve the imaging speed of the thermal mass transfer materials utilized in the present invention, one or more accelerators for azide decomposition may be added to the gas-producing polymer layer or a layer adjacent thereto. Useful accelerators for azide decomposition include those materials known in the art to reduce the decomposition temperature of alkyl azide compounds including, but not limited to, metal complexes such as ferrous acetylacetonate, stannous chloride, magnesium chloride, ferric chloride, zinc bromide, etc.; protic acids such as benzoic acid, acetic acid, p-toluenesulfonic acid, etc.; thermally sensitive free-radical initiators such as benzoyl peroxide, t-butyl perbenzoate, etc.; phosphines such as triphenylphosphine; and the like.

Sensitivity of the thermal mass transfer donor elements of the present invention may also be increased by incorporation of a surfactant (as described by M. R. Porter in *Handbook of Surfactants*: Blackie, Chapman and Hall; New York, 1991), preferably a fluorochemical surfactant. The surfactant may be incorporated in any of the layers of the thermal transfer donor element, preferably in the top layer of the donor element containing the thermal mass transfer material in order to reduce cohesion. Non-limiting examples of fluorochemical surfactants include Fluorad™ surfactants sold by 3M Company.

As mentioned above, the thermal mass transfer material and gas-producing polymer may either be present as a single layer or as separate layers (with the mass transfer material being layered above the gas-producing polymer layer). In the case of a single mass transfer material/gas-producing polymer layer, preparation thereof may be carried out by introducing the components for making the layer into a suitable solvent(s) (e.g., water, tetrahydrofuran (THF), methyl ethyl ketone (MEK), toluene, methanol, ethanol, n-propanol, isopropanol, acetone, etc., and mixtures thereof); mixing the resulting solution at, for example, room temperature; coating the resulting mixture onto the substrate; and drying the resultant coating, preferably at moderately elevated temperatures.

When the thermal mass transfer material is coated as a separate layer on the gas-producing polymer, it may be coated by a variety of techniques including, but not limited to, coating from a solution or dispersion in an organic or aqueous solvent (e.g., bar coating, knife coating, slot coating, slide coating, etc.), vapor coating, sputtering, gravure coating, etc., as dictated by the requirements of the mass transfer material itself.

Nanostructured elements 24 may be prepared in accordance with U.S. Pat. Nos. 4,812,352, 5,039,561, and 5,238,729, the disclosures of which are incorporated herein by reference. Starting materials useful in preparing elongated structures 26 include organic and inorganic compounds. Elongated structures 6 are essentially a non-reactive or passive matrix for the subsequent coating of radiation absorbing material 8. Several techniques or methods are useful for producing the whisker-like configuration of the elongated structures 26. Such methods are described in, e.g., *J. Vac. Sci. Tech.* A 1983, 1(3), 1398–1402; U.S. Pat. Nos. 4,969,545; 4,252,864; 4,396,643; 4,148,294; 4,155,781; and 4,209,008, and such descriptions are incorporated herein by reference.

Useful organic compounds include planar molecules comprising chains or rings over which $\pi$-electron density is extensively delocalized. These organic materials generally crystallize in a herringbone configuration. Preferred organic materials can be broadly classified as polynuclear aromatic hydrocarbons and heterocyclic aromatic compounds. Polynuclear aromatic hydrocarbons are described in Morrison and Boyd, *Organic Chemistry*, 3rd ed., Allyn and Bacon, Inc. (Boston, 1974), Chap. 30. Heterocyclic aromatic compounds are described in Chap. 31 of the same reference.

Preferred polynuclear aromatic hydrocarbons include, for example, naphthalenes, phenanthrenes, perylenes, anthracenes, coronenes, and pyrenes. A preferred polynuclear aromatic hydrocarbon is N,N'-di( 3,5-xylyl)perylene-3,4:9,10 bis(dicarboximide) (commercially available from American Hoechst Corp. under the trade designation of "C. I. Pigment Red 149") [hereinafter referred to as perylene red].

Preferred heterocyclic aromatic compounds include, for example, phthalocyanines, porphyrins, carbazoles, purines, and pterins. More preferred heterocyclic aromatic compounds include, for example, porphyrin, and phthalocyanine, and their metal complexes, for example, copper phthalocyanine (commercially available from Eastman Kodak).

The organic material used to produce elongated structures 26 may be coated onto substrate 12 (or a temporary substrate, as will be explained below) using well-known techniques for applying a layer of an organic material onto a substrate including, but not limited to, vacuum evaporation, sputter coating, chemical vapor deposition, spray coating, Langmuir-Blodgett, gravure, or blade coating. Preferably, the organic material is applied by physical vacuum vapor deposition (i.e., sublimation or evaporation of the organic material under an applied vacuum). The preferred temperature of the substrate during deposition is dependent on the organic material selected. For perylene red, a substrate temperature near room temperature (i.e., about 25° C.) is satisfactory.

In a particularly useful method for generating organic elongated structures 26, the thickness of the deposited organic layer will determine the major dimension (i.e., length) of the elongated structures which form during an annealing step. Elongated structures 26 may be grown on permanent substrate 12 or a temporary substrate with the characteristics and process described in U.S. Pat. No. 5,039,561. An alternative process for generating the elongated structures includes depositing a starting material on a substrate wherein the substrate is at an elevated temperature. Additional starting material is then deposited until high aspect ratio, randomly-oriented elongated structures are obtained. The preferred process for obtaining perylene red elongated structures includes depositing the starting material at or near room temperature and then elevating the substrate temperature to anneal the material (described in Example 1 hereinbelow).

Elongated structures 26 may be produced either on substrate 12 or on a temporary substrate. In either case, the substrate upon which elongated structures 26 are prepared is preferably selected from those materials which will maintain their integrity at the temperatures and pressures imposed upon them during any deposition and annealing steps of materials applied to the substrate. The substrate may be flexible or rigid, planar or non-planar, convex, concave, aspheric or any combination thereof.

Preferred substrate materials upon which elongated structures 26 are prepared (whether a temporary substrate or permanent substrate 12) include organic or inorganic materials, such as, polymers, metals, ceramics, glasses, and semiconductors. The preferred organic substrate is metal-coated polyimide film (commercially available from DuPont Corp. under the trade designation KAPTON). Additional examples of substrate materials appropriate for the present invention are described in U.S. Pat. No. 4,812,352.

Regardless of the method by which elongated structures 26 are prepared, perylene red is the organic material preferred. When the organic material is perylene red, the thickness of the layer (when using the preferred process), prior to annealing, is in the range from about 0.05 to about 0.25 μm, more preferably in the range of 0.05 to 0.15 μm. When the organic materials are annealed, generally uniaxially-oriented elongated structures 26 are produced. Preferably, the elongated structures 26 are monocrystalline or polycrystalline rather than amorphous. The properties, both chemical and physical, of all of the elongated structures 26 taken together are anisotropic due to the crystalline nature and uniform orientation thereof.

Typically, the orientation of the elongated structures 26, and therefore also the orientation of nanostructured elements 24, is uniformly related to the substrate surface upon which they are formed. The elongated structures 26 (and nanostructured elements 24) are preferably substantially uniaxially-oriented normal, i.e., perpendicular, to the substrate surface upon which they are formed. By "substantially uniaxially-oriented normal," it is meant that the major axes of at least 75%, and preferably 90%, of the elongated structures are at an angle between 75° and 105° to the substrate surface. Preferably, the major axes of the elongated structures 26 (and of nanostructured elements 24) are substantially parallel to one another By "substantially parallel," it is meant that the major axes of at least 75%, and preferably 90%, of the elongated structures are within 15° of being parallel to one another.

The elongated structures 26 and nanostructured structures 24 are typically uniform in size and shape, and have uniform cross-sectional dimensions along their major axes. The preferred length (i.e., major dimension) of each elongated structure is in the range of 0.1 to 3.0 μm and, more preferably, in the range of 0.5 to 2.0 μm. The major dimension of each elongated structure 26 is directly proportional to the thickness or amount of the initially deposited organic material when the thickness of the deposited organic material is less than about 0.3 μm. The diameter or cross-sectional width of each elongated structure 26 is preferably less than 0.1 μm.

Preferably, nanostructured elements 24 have a high aspect ratio, i.e., the ratio of the length of each nanostructured element to the diameter or cross-sectional width of each nanostructured element is in the range from about 3:1 to about 100:1.

The areal number density of the nanostructured elements 24 are preferably in the range of 1–100/μm$^2$ and, more preferably, in the range of 40–50/μm$^2$. As used herein, "areal number density" refers to the number of nanostructured elements 24 per unit planar area. Nanostructured elements 24, submicrometer in width and a few micrometers in length, are composites comprising elongated structures 26 conformally, and generally thinly, coated with radiation absorbing material 28. In addition to providing radiation absorbance, the coating material 28 will generally strengthen the nanostructured elements 24.

Radiation absorbing material 28 can be fully conformally coated over the elongated structures 26, producing a generally smooth thin shell around the elongated structures 26. Alternatively, this material can be discontinuously conformally coated such that it consists of small rough particles covering the sides of the elongated structures 26 to further increase the surface area available for radiation absorption and heat dissipation, even over the fully conformally coated elongated structures 26.

Due to the physical characteristics of nanostructured elements 24 (i.e., the sizes, aspect ratios, and areal number densities thereof), the nanostructured elements 24 are extremely effective in absorbing incident electromagnetic radiation. This property is believed to result from multiple scattering events, i.e., reflections/absorptions of incident radiation, which take place between the nanostructured elements 24. As radiation strikes the nanostructured elements, a portion of the radiation will be absorbed by radiation absorbing material 28 while another portion of the radiation will be reflected to other nanostructured elements which, in turn, will absorb a portion of the reflected radiation and reflect a portion to other nanostructured elements. This scattering process continues until all, or nearly all, of the incident radiation is absorbed by nanostructured elements 24. Thus, even though a shiny, highly reflective metal is coated as radiation absorbing material 28 on elongated structures 26, when arrayed on a substrate in accordance with the practice of the present invention, the resultant nanostructured elements 24 will, collectively, appear dark even when exposed to visible light.

In view of the highly effective radiation absorbing properties of the nanostructured elements of the present invention, virtually any radiation absorbing material, even poorly absorbing, highly reflective materials, can be used as radiation absorbing material 26. Thus, radiation absorbing material 26 may comprise any material capable of absorbing at least 1% of incident electromagnetic radiation in a single reflective event. Examples of such materials include metals; metal alloys; conducting polymers such as polyacetylenes and polyvinylpyrroles; semiconducting materials such as silicon, germanium, gallium arsenide, gallium aluminum arsenide, zinc selenide, and cadmium sulfide; and organic pigments and dyes such as porphines, quinones, and methines. 0f these materials, metals are preferred. Because the nanostructured elements of the present invention are so highly effective in absorbing radiation, any atmospherically stable metal may be used as radiaiton absorbing material 28. Thus, from a radiation absorption standpoint, no preference exists for any particular type or types of metal. However, depending upon the application, other concerns such as corrosion, reactivity with the gas-producing polymer, cost, etc., may need to be taken into account in selecting a suitable metal for the radiation absorbing material.

Radiation absorbing material 28 may also comprise black metal. The term "black metal" refers to a mixture of metal, metal oxide, and/or metal sulfide, and may be produced by any suitable method, such as in accordance with the teachings of U.S. Pat. No. 4,430,366, the disclosure of which is incorporated herein by reference. The most preferred mixture is of metal and metal oxide. By the term "black" it is meant that a uniformly thick metal layer provides a transmission optical density of at least 0.3, preferably at least 0.6, more preferably at least 0.8, and most preferably at least 1.0 at the wavelength of the imaging radiation, and the reflected light is less than 20% of the incident light on the black surface.

The wall thickness of radiation absorbing material 28 surrounding each of elongated structures 26 is in the range from about 0.5 nm to about 50 nm, and more preferably from about 5 nm to about 30 nm. Such wall thicknesses can be achieved by depositing radiation absorbing material 28 on elongated structures 26 at a mass equivalent thickness ranging from about 5 nm to about 500 nm. A "mass equivalent thickness" is the thickness of a material which would be achieved if that material were deposited on a planar surface (instead of on the nanostructured surface of the present invention). The thickness of radiation absorbing material 28 may be such that the resulting nanostructured elements 24 remain substantially discrete although there may be substantial contact between the elements.

Radiation absorbing material 28 may be deposited onto elongated structures 26 using any suitable technique. Preferably, the radiation absorbing material is deposited by a method that avoids the disturbance or destruction of elongated structures 26 by mechanical or mechanical-like forces. More preferably, the radiation absorbing material is deposited by vacuum deposition methods, such as, vacuum sublimation, evaporation, sputtering, vapor transport, and chemical vapor deposition.

As depicted in FIGS. 1 and 2, nanostructured elements 24 extend into gas-producing polymer layer 18. This construction results in a highly efficient thermal mass transfer medium by decreasing the loss of radiant imaging energy due to reflection (i.e., by increasing the absorption of such energy) and by increasing the contact surface area between radiation absorbing material 28 and the gas-producing polymer (and optionally the thermal mass transfer material) in gas-producing polymer layer 18. Multiple reflections/absorptions (of radiant imaging energy) between nanostructured elements 24 enhance the absorption and conversion of radiant energy to heat. The increased surface area, in turn, facilitates the diffusion of that heat away from nanostructured elements 24 and into the surrounding gas-producing polymer in layer 18.

For some applications, the efficiency of donor element 10 in thermally transferring an image is high enough that a gas-producing polymer may optionally be excluded from the donor element construction. In this instance, layer 18 contains the thermal mass transfer material 20 with no gas-producing polymer. Heat from radiation absorbing material 28 acts directly on the mass transfer material and causes it to transfer to a receptor sheet by, e.g., sublimation or vaporization of that portion of the mass transfer material which is closest to the irradiated areas of radiation absorbing material 28. This occurs when the vapor pressure of the vaporized portion of the mass transfer material becomes high enough to propel the remaining, non-vaporized portion of the mass transfer material from donor element 10 and onto a receptor sheet. However, it is preferred that a gas-producing polymer be present in the donor element construction. Notwithstanding the effects on the cohesiveness and adhesiveness of the thermal mass transfer material, a gas-producing polymer generally improves the imaging process by allowing the irradiation source to image at greater speed and/or with lower energy usage than would otherwise be possible without a gas-producing polymer.

In addition to increased imaging efficiency, the nanostructured construction of donor element 10 also reduces the size and variation in size of metal particles which are carried over to a receptor sheet during the ablative imaging process when metal is used as radiation absorbing material 28. In this manner, the nanostructured construction of the present donor element serves to improve the quality of the final image.

Gas-producing polymer layer 18 and/or thermal mass transfer material 20 may be applied to nanostructured elements 24 by means appropriate for the particular gas-producing polymer. For example, a gas-producing polymer and/or thermal mass transfer material in a liquid or liquid-like state may be applied to the exposed surface of the nanostructured elements by dip coating, vapor condensation, spray coating, roll coating, knife coating, blade coating, or any other known coating method. A thermal mass transfer material may be applied in a vapor or vapor-like state by using conventional vapor deposition techniques including, for example, vacuum vapor deposition, chemical vapor deposition, or plasma vapor deposition.

A gas-producing polymer and/or mass transfer material that is solid or solid-like may be applied to the exposed surface of the nanostructured elements when liquified by application of a sufficient amount of energy, for example, by conduction or radiation heating, to transform the solid or solid-like material to a liquid or liquid-like material, and then solidifying the liquid or liquid-like material. The applied gas-producing polymer and/or mass transfer material, if liquid or in a liquid-like state, may be solidified by means appropriate to the particular material used. Such solidification means include, for example, curing or polymerizing techniques known in the art, including, for example, radiation, free radical, anionic, cationic, or step growth processes, and solvent evaporation, or combinations thereof. Other solidification means include, for example, freezing and gelling.

Alternatively, the nanostructured elements may be embedded into a solid or solid-like gas-producing polymer and/or mass transfer material by hot-roll calendering, that is, using heat and pressure with a force sufficient to embed the nanostructured elements into the solid gas-producing polymer and/or mass transfer material, but without damaging the nanostructured elements. For example, the nanostructured elements are brought into contact with the solid gas-producing polymer and/or mass transfer material at the nip part of a pair of heated or unheated rollers.

In the embodiment of the present invention shown in FIG. 1, elongated structures 26 may be grown directly on substrate 12 and gas-producing polymer layer 18 (and/or thermal mass transfer material 20) may be applied directly to the newly-grown elongated structures 26 by any of the methods discussed above. Gas-producing polymer layer 18 has a thickness ranging from about 0.5 μm to about 5 μm and, more preferably, from about 1 μm to about 3 μm.

The embodiment shown in FIG. 2 is produced as discussed above, except that elongated structures 26 are grown and coated with radiation absorbing material 28 on a temporary substrate. The resulting nanostructured elements 24 may then be embedded in gas-producing polymer layer 18, which has been separately coated and cured on substrate 12, by pressing nanostructured elements 24 into gas-producing polymer layer 18 (and/or thermal mass transfer material 20) with, e.g., a pair of unheated rollers as described above. The temporary substrate is then delaminated from donor element 10A at the interface of the temporary substrate (not shown) and nanostructured elements 24 by mechanical means such as, for example, pulling the donor element from the temporary substrate, pulling the temporary substrate from the donor element, or both. Cooling or applying heat during the delamination process can facilitate the removal of the temporary substrate due to differences in the thermal expansion coefficients between the gas-producing polymer and the temporary substrate. Moreover, in some instances, the donor element may self-delaminate from the temporary substrate during solidification of the gas-producing polymer. Regardless of the manner in which the temporary substrate is removed, the orientation and areal number density of the nanostructured elements 24 in gas-producing polymer layer 18 is completely preserved.

Alternatively, after nanostructured elements 24 have been grown on a temporary substrate, a gas-producing polymer and/or thermal mass transfer material can be applied thereto in a liquid or liquid-like state and cured (or a thermal mass-transfer material can alone be applied in a vapor or vapor-like state and cured). Thereafter, substrate 12 can be applied to the surface of gas-producing polymer layer 18 opposite that of the temporary substrate by any suitable means, including, e.g., adhesive bonding, UV curing, solvent curing, melt extrusion coating, etc. The temporary substrate can then be removed from the resultant donor element by any of the methods discussed above.

Regardless of the method by which donor element 10A is prepared, surface 22, which had been attached to the temporary substrate, now becomes the upper surface 22 of gas-producing polymer layer 18. In this manner, second end 32 of nanostructured elements 24 are coincident with upper surface 22 of gas-producing polymer layer 18. Thermal mass transfer material 20 is then coated on upper surface 22, thereby directly contacting second end 32 of nanostructured elements 24. First end 30 of nanostructured elements 24 may or may not be in contact with upper surface 14 of substrate 12, but preferably is not in contact therewith.

Although donor element 10A requires the extra preparation step of removing a temporary substrate therefrom, as compared to donor element 10, donor element 10A has the advantage of a wide tolerance in the thickness of the gas-producing polymer layer 18. When nanostructured elements 24 are irradiated, they absorb the radiation, convert it to heat, and transfer that heat to the surrounding gas-producing polymer (and/or thermal mass transfer material 20). Those portions of the gas-producing polymer layer 18 which are heated generate gas to propel the thermal mass transfer material and any unheated gas-producing polymer above the heated portions of the gas-producing polymer away from substrate 12 and towards a receptor sheet (located adjacent top surface 34 of donor element 10 or 10A). With donor element 10, if the thickness of gas-producing polymer above second end 32 of nanostructured elements 24 is too great, the force of the gas generated by the heated portion of the gas-producing polymer may be insufficient to propel the unheated gas-producing polymer and thermal mass transfer material located above the heated portion of the gas-producing polymer off of donor element 10. Thus, the thickness of gas-producing polymer layer 18 in donor element 10 is preferably controlled to be within the range stated above (i.e., between 0.5 and 5 μm). With donor element 10A, however, no gas-producing polymer is located between nanostructured elements 24 and mass transfer material 20. Thus, the total thickness of gas-producing polymer layer 18 is not critical so that a wide tolerance in this dimension is possible. The only requirement is that the thickness of gas-producing polymer layer 18 should be at least as great as the height of nanostructed elements 24. Thus, the thickness of gas-producing polymer layer 18 in donor element 10A may range from about 1 μm to 1000 μm or more. For reasons of material conservation, however, the thickness preferably ranges from about 1 μm to about 10 μm.

The thermal transfer donor elements 10 and 10A of the present invention are used by placing the top surface 34 in intimate contact (e.g., vacuum hold-down) with a receptor sheet and imagewise heating the thermal transfer donor element. In order to provide rapid heating, one or more laser beams are preferably used to provide the energy necessary for transfer. Single-mode laser diodes and diode-pumped lasers producing, for example, 0.1–4 Watt (W) in the near-infrared region of the electromagnetic spectrum may be used as energy sources. Preferably, a solid state laser or laser diode array is employed. Laser exposure dwell times should be from about 0.1 to 5 microseconds and laser fluences should be from about 0.01 to about 1 J/cm$^2$.

Suitable image-receiving (thermal mass transfer-receiving) elements are well known to those skilled in the art. Non-limiting examples of image-receiving elements which can be utilized in the present invention include anodized aluminum and other metals; opaque or transparent polymer films (e.g., polyimides or PET); a variety of different types of paper (e.g., filled or unfilled, calendered, etc.); thermoplastics; and adhesive-coated substrates.

In the practice of the present invention, the thermal transfer donor and receiving elements are brought into contact with one another such that upon application of heat, the thermal mass transfer material is transferred from the donor element to the receiving element. The nanostructured elements 24 utilized in the donor elements of the present invention act as a light-to-heat conversion element. A variety of light-emitting sources can be utilized in the present invention including infrared, visible, and ultraviolet lasers, as well as flash lamps. The preferred lasers for use in this invention include high power (>100 mW) single mode laser diodes, fiber-coupled laser diodes, and diode-pumped solid state lasers (e.g., Nd:YAG and Nd:YLF). The most preferred lasers are diode-pumped solid state lasers. The laser exposure should raise the temperature of the thermal transfer medium, above 150° C. and most preferably above 200° C.

After transfer of the thermal mass transfer material from the donor to the receiving elements, an image is created on the receiving element and the donor element may be removed from the receiving element.

The donor material can be provided as sheets or rolls. When used as color donors for multicolor images, either of these can be single colored uniformly within the article, and multiple articles of different colors can used to produce a multi-colored image. Alternately, the donor materials could contain areas of multiple colors, with a single sheet or roll being used to generate multi-colored images.

As a further alternative, the donor elements may employ a metal thermal mass transfer material for the production of, e.g., a printed circuit board.

Objects and advantages of this invention are further illustrated by the following examples, but the particular materials and amounts thereof recited in these examples, as well as other conditions and details, should not be construed to unduly limit this invention. All materials are commercially available or known to those skilled in the art unless otherwise stated or apparent.

EXAMPLES

Preparation of the Elongated Structures

In the following examples, nanostructured elements according to the present invention were prepared using processes described in U.S. Pat. Nos. 4,812,352 and 5,039,561 and such description is incorporated herein by reference.

Generally, N,N'-di(3,5-xylyl)perylene- 3,4:9,10 bis(dicarboximide), (hereinafter referred to as PR 149), was vacuum vapor deposited onto a flexible polyimide web, near room temperature, to a thickness on the order of 0.1 to 0.15 μm. Thereafter, the substrate and PR 149 coating were annealed in a vacuum sufficient to cause the initially uniform pigment film to convert to an array of elongated structures. After annealing, the elongated structures were discrete, uniformly oriented single crystals, 1 to 2 μm tall, with high aspect ratios (length to width), extremely large areal number densities (40–50/$\mu m^2$), and elongated structure to elongated structure spacings on the order of 0.05 μm. The resulting geometric surface area was increased by a factor of 10 to 15. The elongated structures were then conformally coated with various metal radiation absorbing materials. The resultant nanostructured elements were then embedded into or encapsulated with a gas-producing polymer or colorant, using the methods described above and in U.S. Pat. No. 5,238,729.

Solutions

Solutions used in the examples are as follows:

AD-S BAMO

BAMO (poly[bis (azidomethyl) oxetane]) was obtained from the Aerojet Corp. The material had a MW of about 4500 as determined by GPC. A suspension of 5 g of BAMO in 45 g of MEK was warmed to ~60° C. until the polymer dissolved and then 250 mg of acetylene dicarboxylic acid was added. The resulting solution was heated in a sealed jar at 60° C. for 3 h and then cooled to room temperature before use. NMR analysis indicated the reaction of the alkyne, presumably to form the substituted triazole.

EnGAP

To a solution of 27.4 g of Isopherone diisocyanate (Aldrich Chemical Co.) in 750 g MEK is added 200 g GAP diol/triol mixture with an equivalent weight of 1800 per hydroxyl, and 0.02 g of dibutyl Tin dilaurate (Aldrich Chemical Co.). This was heated to 60° C. while stirring for 24 hr. After cooling, 28.8 g of the above was added with stirring to a solution of 0.2 g of ethylene diamine in 8 g MEK. The mixture was heated to 35° C. while stirring for 2 hours, then cooled to room temperature and diluted to 10% solids with ethanol. To 4 g of the above 10% solution was added 1 drop of a 15% solids solution of FC-170C (a fluorocarbon surfactant from 3M) in MEK. This was coated on 4 mil PET with a #4 Meyer rod, and dried in a 60° C. oven for three minutes.

"GAP-triol" refers to a triol-terminated GAP (glycidyl azide polymer) polymer made according to the procedure disclosed in U.S. Pat. No. 4,962,213, incorporated herein by reference, and having a molecular weight of about 3,500 and a polydispersity index of less than 2.5.

"GAP-diol" refers to a diol-terminated GAP polymer made according to the procedure disclosed in U.S. Pat. Nos. 3,645,917 and 4,268,450, the disclosures which are incorporated herein by reference, and having a molecular weight of about 3,000 and a polydispersity index of less than 2.5.

The following pigment dispersions were prepared according to the recommendations of the manufacturer (CIBA-GEIGY Corp.), using distilled water, concentrated aqueous ammonia and isopropyl alcohol:

UV1: To 1 g $H_2O$ was added 10 mg of conc $NH_3$ and 50 mg Uvinul MS40 (a UV light absorber from GAF Corp.)

63F: 3 g water; 1.2 g CIBA-GEIGY magenta dispersion (25% wt. solids); 0.3 g Vancryl™ 600 emulsion (an adhesive from Air Products and Chemicals Inc.); 1 g of a 5% wt. solids solution of FC 170C (a fluorocarbon surfactant from 3M) in 1:1 isopropyl alcohol; and 1 g UV1

Imaging Constructions

The examples utilize four imaging constructions, defined below. The examples differ by virtue of these constructions, whether a colorant layer or gas-producing polymer layer are used, the kind and placement of the nanostructured elements within the polymer layer, and the process for embedding the nanostructured elements within the gas-producing polymer or colorant.

Construction I

Donor Element—Similar to the construction shown in FIG. 1: an array of nanostructured elements are embedded in the lower surface of a colorant layer on a fluorenone polyester substrate; Receiver—paper; Beam Incidence—through donor substrate Construction II Donor Element—Similar to the construction shown in FIG. 2: an array of nanostructured elements are embedded in the upper surface of a gas-producing polymer layer which, in turn, is disposed on a polyethylene terephthalate (PET) substrate; Receiver—paper; Beam Incidence—through donor substrate Construction III Donor Element—Similar to the construction shown in FIG. 1: an array of nanostructured elements are embedded in the lower surface of a gas-producing polymer layer on a copperized polyimide substrate and a colorant layer is overcoated on the gas-producing polymer layer; Receiver—PET; Beam Incidence—through receiver Construction IV Donor Element—Similar to the construction shown in FIG. 2: an array of nanostructured elements are embedded in the upper surface of a gas-producing polymer layer which, in turn, is disposed on a polyethylene terephthalate (PET) substrate and a colorant layer is overcoated on the gas-producing polymer layer; Receiver—paper; Beam Incidence—through donor substrate Example 1

This example used Imaging Construction I. An array of short elongated structures, 0.35 micrometers tall and ~0.05 micrometers in widest crossection at a number density of 30–40/square micrometer, was grown on a 30 cm×120 cm sheet of 50 μm thick fluorenone polyester (FPE), available from 3M Co., by the general process described above (and in more detail in U.S. Pat. No. 5,238,729). The elongated structures are composed of the red organic pigment PR149, available from American Hoechst Celanese. A thin layer of Ag was sputter deposited onto the array of elongated structures until it turned optically black, (typical thicknesses of such conformal coatings are ~100 Å on each elongated structure). An 18 cm×25 cm piece of the so-coated FPE was further overcoated with 63F, embedding the resultant nanostructured elements in a colorant layer. The colorant was applied by taping the piece to a glass plate, pouring the solution over the nanostructured film, tipping it to allow the excess to flow off, and controling the rate of drying by placing the plate in a humid atmosphere in the tipped orientation for approximately 1 minute. This produced a variable thickness in the colorant layer. Following this the sample was placed in a 70° C. air oven for 5 minutes. The sample piece was placed against a clay coated paper and exposed to a scanning YAG laser beam incident on the back of the FPE substrate. The beam conditions were 1.2 watts at 3400 cm/sec with a 17–19 micrometer diameter beam. Transfer of the magenta colorant to the paper occured only in the thinnest areas of the coating, later determined by scanning electron microscopy to be ~1 micrometer thick. The optical density of the image on the receiver in these areas was very high, appearing fully opaque. Scanning electron micrographs (SEMs) of the donor showed all the colorant and nanostructured elements were gone in the areas which imaged.

Examples 2–4 Use Imaging Construction II, Above

Example 2

A nanostructured array similar, but with longer elongated structures, to that used in Ex. 1 was produced on a copper coated polyimide substrate. The elongated structures were 1.5 to 2 micrometers long and conformally coated with Ag until optically black to form nanostrucured elements. A small piece, 5 cm×6.4 cm, was placed, nanostructured element side down, onto a similar sized piece of enGAP-coated polyester. The assembly was passed through a pair of unheated smooth steel rollers, 4.125 cm diameter, under ~26 Newtons/lineal cm pressure at ~1.25 cm/sec., to press the nanostructured elements into the surface of the enGAP. The copper polyimide substrate could then be peeled away leaving the nanostructured elements in the surface of enGAP layer on the PET substrate. The surface of the latter sample containing the nanostructured elements was placed against a sheet of paper and the construction exposed through the PET with the YAG laser as described in Ex. 1, except a scan rate of 6400 cm/sec was used. A reddish image (from the red PR 149 pigment used to form the elongated structures) of high optical density was transfered uniformly to the paper receiver. SEM micrographs show the entire enGAP layer thickness was removed in the imaged areas from the PET substrate.

Example 3

A similar nanostructured array of Ag-coated elongated structures was used as in Ex. 2. They were embedded by cold pressing them with the steel rollers into the surface of a 1 micrometer thick layer of AD-5 BAMO coated on 50 μm thick PET, followed by delamination of the original polyimide film. The roller pressure was ~88 Newtons/lineal cm, at ~1.25 cm/sec. The sample, 6 cm×6 cm in size, was imaged as described in Ex. 2, producing a similar result.

Example 4

This example repeated the conditions of Ex. 3 except the elongated structures were coated with ~50% more Ag, and enGAP was used instead of AD-5 BAMO as a gas-producing polymer. Similar image transfer results were obtained.

Examples 5–8 Use Imaging Construction III, Above

Example 5

A nanostructured array with elongated structures ~1 micrometer tall was prepared by vacuum deposition of a 1000 Å film of PR149 pigment (as in Ex. 1), onto an 8 cm diameter substrate of copper coated polyimide, followed by annealing in vacuum at ~200° C. for 1 hour. The resulting elongated structures were coated with a mass equivalent thickness of 500 Å of aluminum, resulting in an average conformal thickness of ~50 Å of Al surrounding each elongated structure. The resultant nanostructured surface was then spin coated with enGAP by applying ~0.5 ml of a 10% enGAP solution in MEK at 1700 rpm, followed by air drying at 64° C. for 20 minutes. The enGAP surface was then coated with a blue printing ink (Kohl-Madden, Colorset Process Blue MSF-30928, Ink 17) dissolved in MEK, with a #10 Meyer bar, and dried at 67° C. for 15 minutes. The resulting ink layer thickness was determined by SEM to be 0.42 micrometers. The so- prepared donor element was placed with the ink side against a transparent PET receiver and exposed to a YAG laser scanning at 3200 cm/sec. The ink was transferred to the PET receiver, with generally better transfer where the enGAP was thickest.

Example 6

An array of ~2 micrometer long elongated structures was prepared on copper coated polyimide as in Ex. 5., and sputter coated with a mass equivalent thickness of 1500 μm of NiCr. The sample was stretch mounted between 10 cm diameter stainless steel rings. The resultant nanostructured elements were embedded in enGAP by applying 1 ml of a 0.25% solution (by wt) of enGAP in MEK to the sample surface. The solution completely wet the surface, but dried in patches. The sample was removed from the steel rings and spin coated with a 5% wt solution of the enGAP in MEK until the surface appeared fully covered with polymer after drying, although the enGAP thickness was still nonuniform. Two coats of the blue printing ink was applied as in Ex. 5. The sample was placed against a PET receiver and imaged as in Ex. 5 at a scanner rotation of 1600 cm/sec. The ink transferred to the PET, with increased optical density over Ex. 5.

Example 7

Nanostructured film material similar to that in Ex. 2 was used. A 6 cm×6 cm piece of the material was placed with the nanostructured elements against a similar sized piece of AD-5 BAMO coated PET as used in Ex. 3. The assembly was passed through a hot-roll laminator (Laminex™) set at 240° F. Under these conditions, the AD-5 BAMO layer transfered off its PET substrate to overcoat and encapsulate the nanostructured array on the copper coated polyimide (construction III). A #10 Meyer bar was used to coat a magenta pigment 63F layer over the AD-5 BAMO surface, followed by air drying at 60° C. for a few minutes. The sample was imaged as in Ex. 6, with YAG scanning at 1600 cm/sec. Transfer of the magenta pigment to the PET receiver was obtained.

Example 8

A sample of similar construction to that of Ex. 7 was made, but using enGAP in place of the AD-5 BAMO as the gas-producing polymer. Imaged under the same conditions as Ex. 7, similar transfer was obtained. SEM micrographs of the imaged areas of the donor show the colorant layer and exotherm layer are removed from the copper coated polyimide substrate.

Example 9 Used Imaging Construction IV, Above.

Example 9

A nanostructured array in the surface of a layer of enGAP coated on PET was prepared, identical to that of Ex. 4, except 5 cm×15 cm. The nanostructured element-containing surface of the enGAP was coated half with the magenta pigment of Ex. 7, and half with the printing ink of Ex.5. The sample was placed with the colorant side against coated paper receiver and imaged with a YAG laser scanning at 1600 cm/sec. The blue printing ink was observed to transfer to the paper, but not the magenta pigment. Apparently, the pressure of the gas produced by heating the enGAP was sufficient to overcome the cohesive force of the ink layer, but was insufficient to overcome the cohesiveness of the more rigid pigment layer.

What is claimed is:

1. A thermal transfer donor element, comprising:

a) a substrate having an upper major surface and a lower major surface;

b) a gas-producing polymer layer on the upper major surface of said substrate, said gas-producing polymer layer having a thermally available nitrogen content of greater than 10 weight percent;

c) a plurality of discrete nanostructured elements having a chemical composition which is different from the chemical composition of the substrate, each of said discrete nanostructured elements comprising an elongated structure coated with a radiation absorbing material, wherein at least some of the discrete nanostructured elements extend into said gas-producing polymer layer, one end of said at least some discrete nanostructured elements contacting the upper major surface of said substrate; and d) a thermal mass transfer material in or over said gas-producing polymer layer.

2. The donor element of claim 1 wherein said substrate is substantially transparent.

3. The donor element of claim 1 wherein said gas-producing polymer layer has a thermally available nitrogen content of greater than about 20 weight percent.

4. The donor element of claim 3 wherein said gas-producing polymer layer has a thermally available nitrogen content of greater than about 30 weight percent.

5. The donor element of claim 1 wherein said gas-producing polymer layer contains a gas-producing polymer having the formula $$(X \leftarrow R \rightarrow_n)_m L$$

wherein:

X represents a hydroxyl, azide, mercapto, or amino group;

R represents a divalent monomer group, containing a $N_3$ group, derived from a cyclic ether, a cyclic sulfide, or a cyclic amine;

L represents a mono-, di-, tri- or tetra-valent alkyl radical, and correspondingly, m represents 1, 2, 3, or 4; and n represents any integer greater than 1.

6. The donor element of claim 1 wherein said gas-producing polymer layer contains a polyoxetane having recurring units of the formula

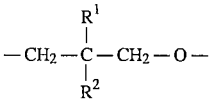

wherein $R^1$ and $R^2$ each independently represent a thermally decomposable nitrogen-containing group.

7. The donor element of claim 1 wherein said gas-producing polymer layer contains a block or random copolymer comprising units derived from at least two different monomers, at least one of said monomers containing an energetic nitrogen-containing group.

8. The donor element of claim 1 wherein said elongated structure comprises an organic compound wherein the molecules thereof are planar and comprise chains or rings over which π-electron density is extensively delocalized.

9. The donor element of claim 8 wherein said organic compound is selected from the group consisting of polynuclear aromatic hydrocarbons and heterocyclic aromatic compounds.

10. The donor element of claim 9 wherein said organic compound is selected from the group consisting of perylenes and porphyrins.

11. The donor element of claim 10 wherein said organic compound is N,N'-di(3,5-xylyl)perylene-3,4:9,10 bis(dicarboximide).

12. The donor element of claim 1 wherein said radiation absorbing material is conformally coated on said elongated structure.

13. The donor element of claim 12 wherein said radiation absorbing material is selected from the group consisting of metals, metal alloys, black metal, conducting polymers, semiconducting materials, and organic pigments and dyes.

14. The donor element of claim 1 wherein said radiation absorbing material is metal.

15. The donor element of claim 1 wherein said nanostructured elements are embedded in a regular or random array within said gas-producing polymer.

16. The donor element of claim 15 wherein each of said nanostructured elements has a first end in contact with the upper major surface of said substrate and a second end contained within said gas-producing polymer layer.

17. The donor element of claim 16 wherein the major axes of said nanostructured elements are substantially parallel with one another.

18. The donor element of claim 17 wherein said nanostructured elements are oriented such that their major axes are substantially normal to the upper major surface of said substrate.

19. The donor element of claim 1 wherein said nanostructured elements have an average aspect ratio ranging from about 3:1 to about 100:1.

20. The donor element of claim 1 wherein said nanostructured elements have an areal number density ranging from about 1–100/$\mu m^2$.

21. The donor element of claim 1 wherein each of said nanostructured elements has a substantially uniform cross-sectional dimension along their major axes.

22. The donor element of claim 1 wherein said thermal mass transfer material comprises a colorant.

23. The donor element of claim 22 wherein said colorant comprises a pigment.

24. The donor element of claim 22 wherein said colorant comprises a dye.

25. The donor element of claim 1 wherein said thermal mass transfer material comprises a metal.

26. A thermal transfer donor element, consisting essentially of:

a) a substrate having an upper major surface and a lower major surface;

b) a thermal mass transfer material on the upper major surface of said substrate; and c) a plurality of discrete nanostructured elements having a chemical composition which is different from the chemical composition of the substrate, each of said discrete nanostructured elements comprising an elongated structure coated with a radiation absorbing material, wherein at least some of the discrete nanostructured element extend into said thermal mass transfer material, one end of said at least some discrete nanostructured elements contacting the upper major surface of said substrate.

27. A thermal transfer donor element, comprising:

a) a substrate having an upper major surface and a lower major surface;

b) a gas-producing polymer layer on the upper major surface of said substrate, said gas-producing polymer layer having a thermally available nitrogen content of greater than 10 weight percent;

c) a plurality of discrete nanostructured elements, each of said discrete nanostructured elements comprising an elongated structure coated with a radiation absorbing material, wherein at least some of the discrete nanostructured elements extend into said gas-producing polymer layer, one end of said at least some discrete nanostructured elements contacting the upper surface of said gas-producing polymer layer and the other end of said at least some discrete nanostructured elements do not contact the substrate; and d) a thermal mass transfer material in or over said gas-producing polymer layer.

28. The thermal transfer donor element of claim 27, wherein none of the discrete nanostructured elements contact the substrate.

29. The thermal transfer donor element of claim 27, wherein the discrete nanostructured elements have a chemical composition which is different from the chemical composition of the substrate.

30. The thermal transfer donor element of claim 27, wherein none of the discrete nanostructured elements contact the substrate.

31. The thermal transfer donor element of claim 27, wherein the discrete nanostructured elements have a chemical composition which is different from the chemical composition of the substrate.

32. The donor element of claim 27 wherein the major axes of said nanostructured elements are substantially parallel with one another.

33. The donor element of claim 32 wherein the major axes of said nanostructured elements are substantially perpendicular to the upper major surface of said substrate.

34. A thermal transfer donor element, consisting essentially of:

a) a substrate having an upper major surface and a lower major surface;

b) a thermal mass transfer material on the upper major surface of said substrate; and c) a plurality of discrete nanostructured elements, each of said discrete nanostructured elements comprising an elongated structure coated with a radiation absorbing material, wherein at least some of the discrete nanostructured elements extend into said thermal mass transfer material, one end of said at least some discrete nanostructured elements contacting the upper surface of said thermal mass transfer material and the other end of said at least some discrete nanostructured elements do not contact the substrate.

35. The donor element of claim 34 wherein the major axes of said nanostructured elements are substantially parallel with one another.

36. The donor element of claim 35 wherein the major axes of said nanostructured elements are substantially perpendicular to the upper major surface of said substrate.

37. A process for forming a thermal transfer image, comprising the steps of:

a) contacting a receptor surface with the layer of the donor element of claim 1 which contains said thermal mass transfer material; and b) imagewise irradiating said donor element with sufficient energy to produce gas from said gas-producing polymer, thereby transferring the thermal mass transfer material of said donor element to said receptor surface in the imagewise irradiated areas.

38. An imaged article made according to the process of claim 37.

* * * * *